United States Patent [19]

Lindal

[11] 4,274,241

[45] Jun. 23, 1981

[54] METAL REINFORCED WOOD TRUSS AND TIE MEANS

[76] Inventor: S. Walter Lindal, 1120-Eighth Ave., #1702, Seattle, Wash. 98101

[21] Appl. No.: 24,113

[22] Filed: May 4, 1979

[51] Int. Cl.[3] ..... E04C 3/292; E04C 3/18

[52] U.S. Cl. ..... 52/642; 52/693; 411/461; 411/466

[58] Field of Search ..... 52/642, 643, 693–696; 85/13

[56] References Cited

U.S. PATENT DOCUMENTS

| | | | |
|---|---|---|---|
| 1,737,601 | 12/1929 | Macomber . | |
| 1,879,295 | 9/1932 | Kahn . | |
| 1,951,810 | 3/1934 | Schaffert . | |
| 1,951,811 | 3/1934 | Schaffert . | |
| 2,083,055 | 6/1937 | Coddington . | |
| 2,154,944 | 4/1939 | Kullmer . | |
| 2,421,197 | 5/1947 | Green . | |
| 2,844,852 | 7/1958 | West . | |
| 2,937,418 | 5/1960 | Sanford . | |
| 2,988,854 | 6/1961 | McKinley . | |
| 3,110,933 | 11/1963 | Cadmus . | |
| 3,531,904 | 10/1970 | Sanford | 52/642 X |
| 3,708,942 | 1/1973 | Leonard | 52/694 |
| 3,946,532 | 3/1976 | Glib | 52/692 |
| 3,985,459 | 10/1976 | Glib | 403/217 |
| 4,016,698 | 4/1977 | Rogers | 52/656 |
| 4,031,686 | 6/1977 | Sanford | 52/693 |

FOREIGN PATENT DOCUMENTS

| | | | |
|---|---|---|---|
| 2113756 | 10/1972 | Fed. Rep. of Germany | 52/693 |
| 1100070 | 9/1955 | France | 52/693 |
| 846599 | 8/1960 | United Kingdom | 52/693 |

*Primary Examiner*—J. Karl Bell

[57] ABSTRACT

Wood trusses used in building construction which have reinforced chord members. The reinforcing is made of sheet metal steel strips which have nail-like teeth punched from their surface, which are pressed into the wood chord members along their entire length. The steel strips overrun the length of the truss slightly and the ends are used as a tie down means. The continuous steel strips may also be used as connector plates to attach the chords to the truss webbing. The steel strips also serve to hold the trusses in a pre-cambered position.

3 Claims, 13 Drawing Figures

METAL REINFORCED WOOD TRUSS AND TIE MEANS

FIELD OF INVENTION

This invention relates to an improvement in building construction relative to the use of wood roof and floor trusses. The strength of the wood members is increased by the use of continuous steel strips which also serve as a means to tie the trusses to supporting walls and to hold the trusses in a pre-cambered configuration. The reinforcing steel strips may also serve as connector plates to hold the truss assembly together.

SUMMARY OF INVENTION

Recently wood trusses assembled with sheet steel teethed plates, known as truss connector plates, have suffered failures which has led to demand for heavier wood members and to regulator changes requiring the use of larger dimensioned lumber. This has made some flat truss designs impractical because there isn't height enough for the new required members, and the dimension lumber required for larger trusses is not available from regular lumber stocks. The need here is to increase the strength of the cord members without increasing the size of lumber used. To do this I have introduced steel reinforcing strips which run the length of the cord member and are attached to the wood using integral nail-like teeth which are pressed out of the surface of the steel strip and which are pressed into the wood member at close intervals along its entire length. The steel strips add substantially to the strength of the wood without materially increasing the bulk of the truss member. The steel strips can also serve to improve the truss in other ways. The strips can be widened and made with more teeth so that they can serve as truss plates, and also to hold the truss assembly together. The strips can be allowed to overrun the ends of the truss and the tail ends can be used to attach the truss to its bearing. Trusses are held in a pre-cambered position by truss connectors; the full length steel strips would do this better by acting bowstring-like. The use of metal can be economized when the strips are used as connector plates with flat trusses by splitting the strips in a zig-zag fashion so that they are wider at the alternate top and bottom cord and web junction points.

DESCRIPTION OF THE PREFERRED EMBODIMENTS

Figure 1:
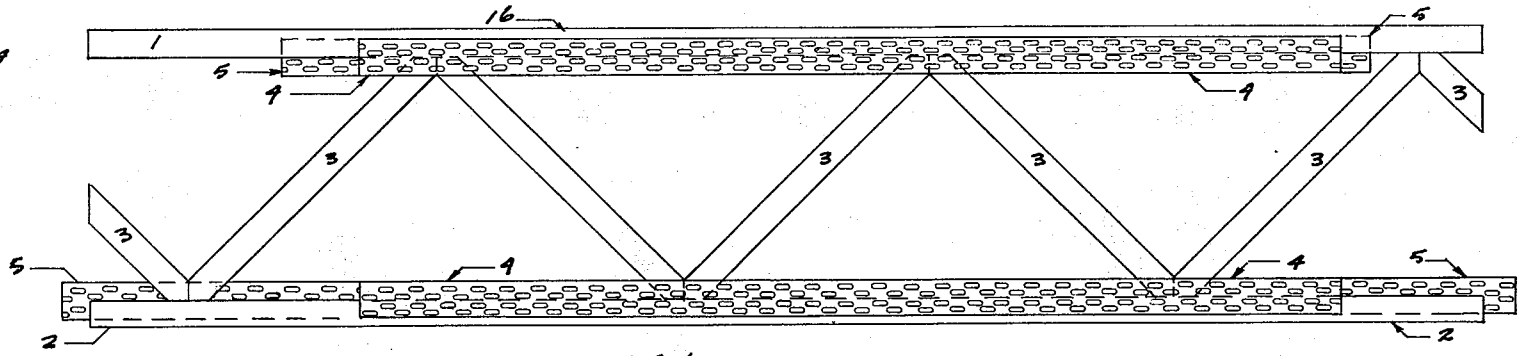
FIG. 1 is the mid-part of a flat truss showing continuous sheet metal reinforcing and connector strips which hold the truss together. The ends are broken off in a stepped fashion showing the layers of truss construction.
Figure 2:
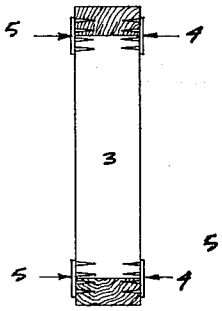
FIG. 2. Is a cross section of the flat truss and illustrates the nail like teeth which are punched out of the metal strips.
Figure 3:
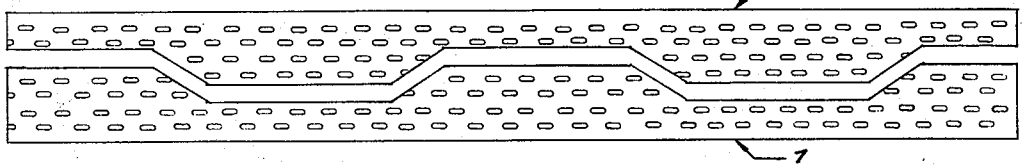
FIG. 3. shows how the continuous connector plates can be split so that they have more nail area at junction points than inbetween.
Figure 4:
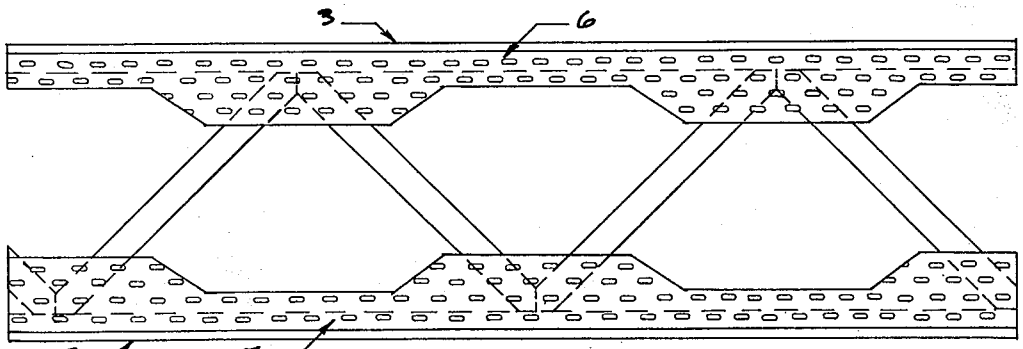
FIG. 4. shows another mid-section of a flat truss using continuous reinforcing connector plates which have been split as in FIG. 3. to give more nailing area at alternate upper and lower junction points.
Figure 5:
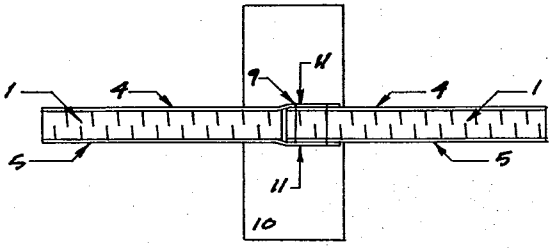
FIG. 5. shows a connection between two trusses using steel strips that overrun from one truss to be attached to the second truss.
Figure 6:
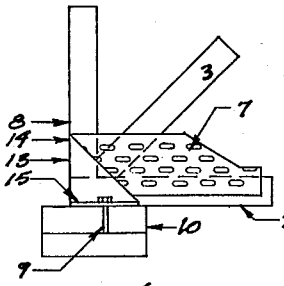
FIG. 6. shows a side view of the bottom corner of a truss which has been anchored down to a bearing wall by folding down the extended ends of the continuous reinforcing strips and nailing them to a wall plate.
Figure 7:
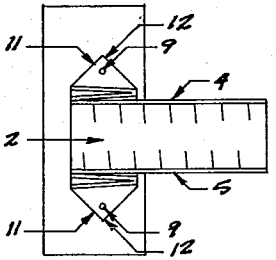
FIG. 7. shows a top view of the same fold-down anchoring system as in FIG. 6.
Figure 10:
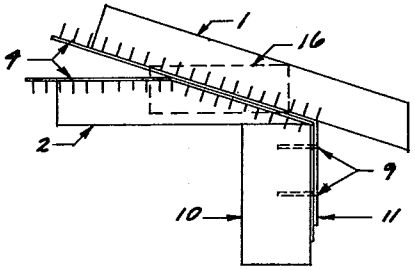
FIG. 10. is an enlarged view of the base end of pitched truss in FIG. 8., which also illustrates the passing of the reinforcing strips between the top and bottom chords and also how the strips are extended to serve as an anchoring means.

In each of the drawings 1 is a top chord of a truss; 2 is the bottom chord; and 3 is the web members of the truss; 4 is the toothed reinforcing and connector strip on one side of the truss; and, 5 is the reinforcing and connector strip on on the other side of the truss. On the second page of the drawing 4 is a toothed reinforcing strip only and runs on the bottom edge of the top chords and on the top edge of the bottom cord; 6 and 7 are top and bottom connector strips that have been split in a zig-zag manner; 8 is the end web of the flat truss; 9 are nails used to tie down the truss; 10 is a wall or base to which the trusses are attached; 11 are the overrun ends of the reinforcing and connector strips whose teeth have been removed and which serve as anchoring means.

Figure 12:
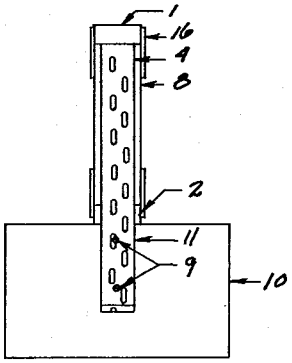
FIG. 12. is an end view of the flat truss shown in FIGS. 9. and 11. This shows the way the overrun ends of the reinforcing strips are used to anchor down the truss.
Figure 8:
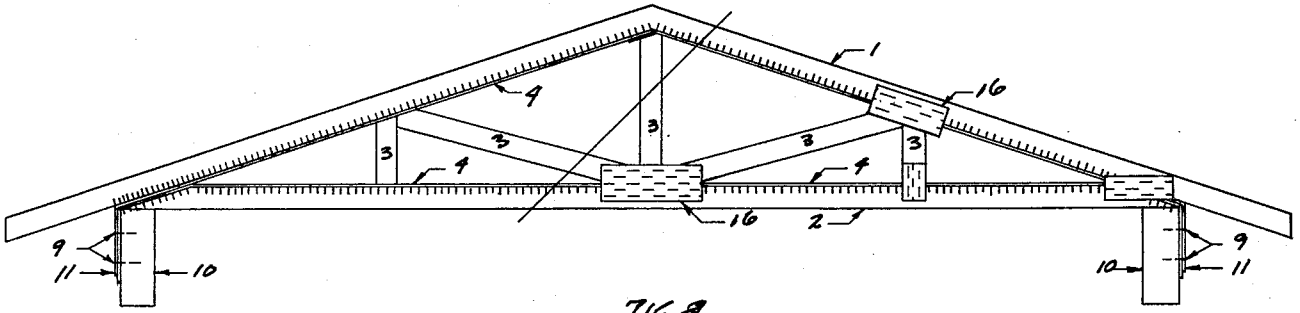
FIG. 8. (page 2 of drawings) shows a pitched roof truss using continuous teeth steel strips for reinforcing only. Part of the drawing shows the truss without standard truss connector plates to illustrate how the reinforcing strips run between the wood members at the junction points and between the truss plates.
Figure 9:
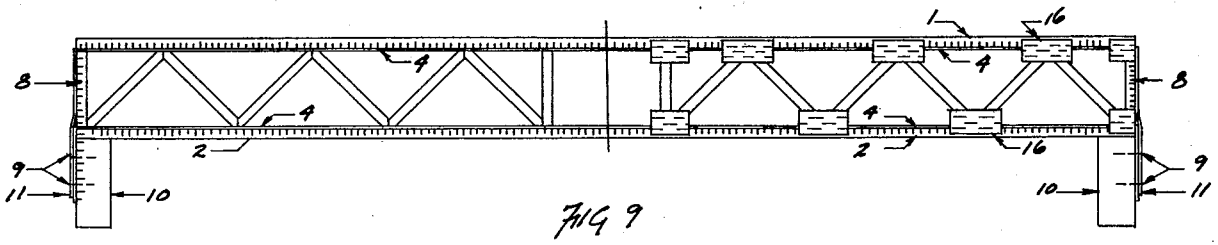
FIG. 9. is an illustration of a flat truss and is similar to the drawing in FIG. 8.
Figure 11:
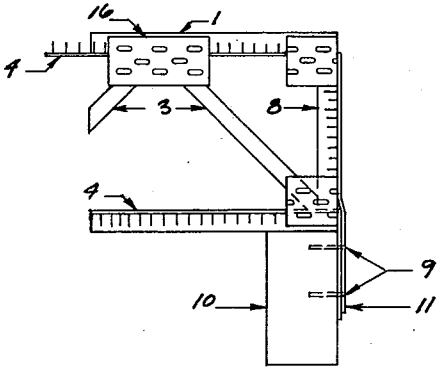
FIG. 11. shows an enlarged end view of the flat truss in FIG. 9., again showing the placement of the reinforcing strips between wood members and the anchoring-down means.
Figure 13:
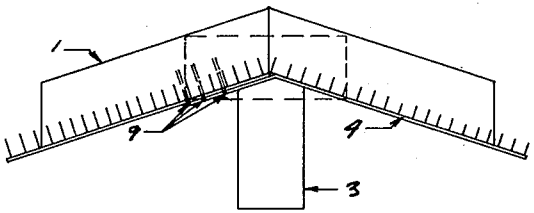
FIG. 13. is an alternate ridge assembly for the pitched truss, showing a strip of steel extending beyond one side of the truss to the other side and attached to that side.

FIGS. 12., 13., 14., and 15., are folds in the overrun ends fashioned to form an anchoring means; 16. shown on the second page only are regular truss connector plates.

What I claim my invention is:

1. A webbed wood truss whose chords are reinforced by chord length strips of sheet metal attached to the chords by integral nail-like teeth punched out of the surface of the metal and pressed into the wood; said steel strips also serve as connector plates to hold the truss together.

2. A wood truss as in claim 1, which has steel strip connector plates that are split from sheet metal so that they are wider at web and chord junction points than between the junction points.

3. A webbed wood truss whose cords are reinforced by chord length strips of sheet metal attached to the chords by integral nail-like teeth, punched out of the surface of the metal and pressed into the wood, said steel strips overrun the ends of the chords a short distance to serve as tie down means for the truss.

* * * * *